US005292090A

United States Patent [19]

Wetzel et al.

[11] Patent Number: 5,292,090

[45] Date of Patent: Mar. 8, 1994

[54] SIMULATOR FOR RAILROAD HOT WHEEL DETECTOR

[75] Inventors: Donald C. Wetzel, Berea; Walter N. Arth, Jr., Middleburg Heights, both of Ohio

[73] Assignee: Meg Trans Corp., Berea, Ohio

[21] Appl. No.: 984,539

[22] Filed: Dec. 2, 1992

[51] Int. Cl.[5] ..... B61K 9/04

[52] U.S. Cl. ..... 246/169 R; 105/451; 374/2

[58] Field of Search ..... 246/1 R, 169 R, 169 A, 246/169 D, DIG. 1, DIG. 2; 105/215.1, 451, 463.1; 374/1, 2; 73/146

[56] References Cited

U.S. PATENT DOCUMENTS

| | | | |
|---|---|---|---|
| 3,294,969 | 12/1966 | Sibley | 246/169 D |
| 3,313,933 | 4/1967 | Sibley | 246/169 R |
| 3,767,146 | 10/1973 | Gallagher | 246/169 D |
| 4,268,257 | 5/1981 | Villar | 73/866.4 X |
| 4,878,437 | 11/1989 | Myers et al. | 104/451 |
| 4,974,797 | 12/1990 | Myers et al. | 246/169 A |
| 5,100,243 | 3/1992 | Grosskopf et al. | 374/2 |

FOREIGN PATENT DOCUMENTS

| | | | |
|---|---|---|---|
| 1439006 | 11/1988 | U.S.S.R. | 246/169 R |

*Primary Examiner*—Frank E. Werner
*Assistant Examiner*—Scott L. Lowe
*Attorney, Agent, or Firm*—Rankin, Hudak & Hill

[57] ABSTRACT

A simulator is provided for verifying the proper operation of railroad rolling stock hot wheel detectors. The simulator includes heaters mounted on trucks of a railroad car, between the wheels and within the profile of the thickness of the wheels. Shock mounts, spring mounts and safety cables are used. An electromagnet is mounted on the heater to trip a sensor to activate the detector and a sensor on the car is used to determine the ambient temperature. Each heater includes a heater temperature sensor and is maintained at a constant temperature above ambient to approximate the thermal radiation of a hot wheel. Each heater is adjusted to direct heat horizontally outwardly from the truck to permit a hot wheel detector adjacent to and outside of the rail to detect a hot wheel. The car has two trucks with one heater on each side of each truck. One heater on each side simulates a temperature approximately equal to a hot wheel. The other heater on each side simulates a lower temperature and should not be detected as a hot wheel. The simulator can be integrated with a hot bearing simulator system.

25 Claims, 5 Drawing Sheets

SIMULATOR FOR RAILROAD HOT WHEEL DETECTOR

BACKGROUND OF THE INVENTION

1. Field of the Invention

This invention relates generally to the field of railroad hot wheel detection and specifically to a hot wheel simulator which verifies proper operation of hot wheel detectors.

2. Description of Related Art

Hot wheel detectors are commonly used on railroads. The detectors include heat sensing scanners which are located at designated points along railroad tracks. The scanners sense the temperature of wheels on passing railroad rolling stock and, typically, transmit the sensed temperature information to a telemetry unit. At the telemetry unit, the sensed wheel temperature is compared against a reference and, if the reference temperature is exceeded, an alarm is transmitted via the telemetry unit to the locomotive engineer or a control tower.

The detectors are usually optical pyrometers aimed at the top of the rail or just above the top of the rail to detect excessive heat. A detector is typically aimed at an acute angle with respect to the tracks, so that it measures the thermal radiation from a wheel on the near rail and then, as the train moves past, from a corresponding wheel on the far rail. The thermal radiation measured is converted to a temperature reading.

Frequently, the detectors are activated by magnetic sensing transducers mounted near the rail which are triggered by the metal of the wheel. The magnetic sensors can be located near the detector location to activate the detector as each wheel passes or the sensors can be located to activate the detector for the entire duration of a train and deactivate the detector after the train has passed.

A hot wheel, as is known in the art, is one which has exceeded a certain temperature, thereby indicating an undesirable condition. A hot wheel can be caused by a number of problems. Most commonly, a wheel which is not rotating properly because of a stuck brake or a hindrance will create excessive friction between the wheel and the rail. A hot wheel which is not detected results in decreased efficiency and possibly greater problems such as derailment. Consequently, it is important that the detectors properly detect hot wheels. When a hot wheel is detected, the train is stopped to determine if the wheel is actually hot. If it is hot, the car is removed from service to be repaired. If the wheel is not hot, the stoppage creates an unnecessary delay. Therefore, it is important that train stoppages for hot wheels occur only when a wheel is actually defective. Thus, all hot wheel detectors must be properly aligned and calibrated to detect heat in the correct location and temperature range.

Verification and maintenance of hot wheel detectors is typically carried out by railroad employees who travel along the track periodically and who stop and verify the detectors along the route. Such maintenance and calibration procedures are labor intensive and expensive. More importantly, maintenance personnel are able to check the detectors only under static conditions. Hot wheel detectors may appear to be operating properly under static conditions but may, in fact, fail to detect hot wheels under the dynamic conditions created by passing trains.

It is desirable to provide an apparatus for verifying hot wheel detectors which monitors the operation of such detectors under dynamic conditions caused by the passage of a load along the railroad track. A heater for simulating a hot wheel could be located outboard of a wheel and be suspended below the truck or it could be mounted on a bracket with a hot bearing simulator. However, the Association of American Railroads has defined a railroad car profile in which a car and all its attachments must fit to maintain safe clearances on American railroads. This simulator must not interfere with the standard clearances and should be protected from impact with objects in the path of the train.

A problem related to hot wheels is hot wheel bearings on railroad rolling stock. Hot bearing detectors are known and are often installed jointly with hot wheel detectors. Dynamic hot bearing simulators have been described, for example, in U.S. Pat. Nos. 4,878,437 and 4,974,797 to Myers et al. These hot bearing simulators direct heat vertically downwardly to trigger the hot bearing sensors which scan generally upwardly. It is desirable to have a hot wheel simulator which can be installed with a hot bearing simulator so that they can operate and cooperate simultaneously.

SUMMARY OF THE INVENTION

The present invention provides an apparatus for simulating a hot wheel on railroad rolling stock to verify the operation of a hot wheel detector. The simulator includes a movable carriage having left and right sides and at least one wheel rotatably mounted on the left side of the carriage. The wheel has substantially parallel inner and outer faces defining substantially parallel planes. At least one heater is disposed substantially between the planes of the faces of the left wheel to simulate a hot wheel.

The movable carriage is usually a test car which is commonly used by railroads and has a variety of devices on board for testing and analyzing railroad equipment. Included among these devices are the aforementioned hot bearing simulators. The hot wheel simulator is installed and cooperates with the hot bearing simulators.

A typical test car has two trucks. Each of the two trucks has two axles with a wheel at each end. The heater is mounted on one side of the truck within the profile of the wheels. The heater should be mounted between the axles so that the wheels guard against impact with obstructions and for simple mounting. The heater is positioned so as to direct heat horizontally outwardly above the rail on which the car is riding. The heater is at a height corresponding with the field scanned by the hot wheel detector.

A pair of high and low temperature heaters should be mounted on each side of the test car so that the direction of movement of the car does not affect operation.

An ambient temperature sensor is mounted on the truck. The temperature of the heater is controlled by varying power supplied to the heater in response to the ambient temperature sensed.

Each high temperature heater is mounted on one of the trucks. When the high temperature heater is energized it emits the same thermal radiation as a hot wheel. The heater maintains a constant temperature above ambient so that it has similar thermal characteristics to those of a hot wheel. That is, a hot wheel sensor will detect a hot wheel when the high temperature heater is within its range.

Each low temperature heater is mounted on the other truck, on the same side as the high temperature heater. When energized, the low temperature heater maintains a constant temperature above ambient so that it emits slightly less thermal radiation than a hot wheel. That is, the heater appears to a hot wheel detector to be a wheel having a lower temperature than a hot wheel.

An electromagnet is mounted on each heater to activate the detector. As the test car passes a detector, the high and low temperature heaters cooperate so that the high temperature heater will trigger a hot wheel indication in the detector and the low temperature heater will not.

If the detector does not respond properly, it might mean that the detector is inoperative, misaligned, miscalibrated or otherwise defective and needs attention. In this manner, the hot wheel simulator can verify the operation of a hot wheel detector.

DESCRIPTION OF THE PREFERRED EMBODIMENT

Figure 1:
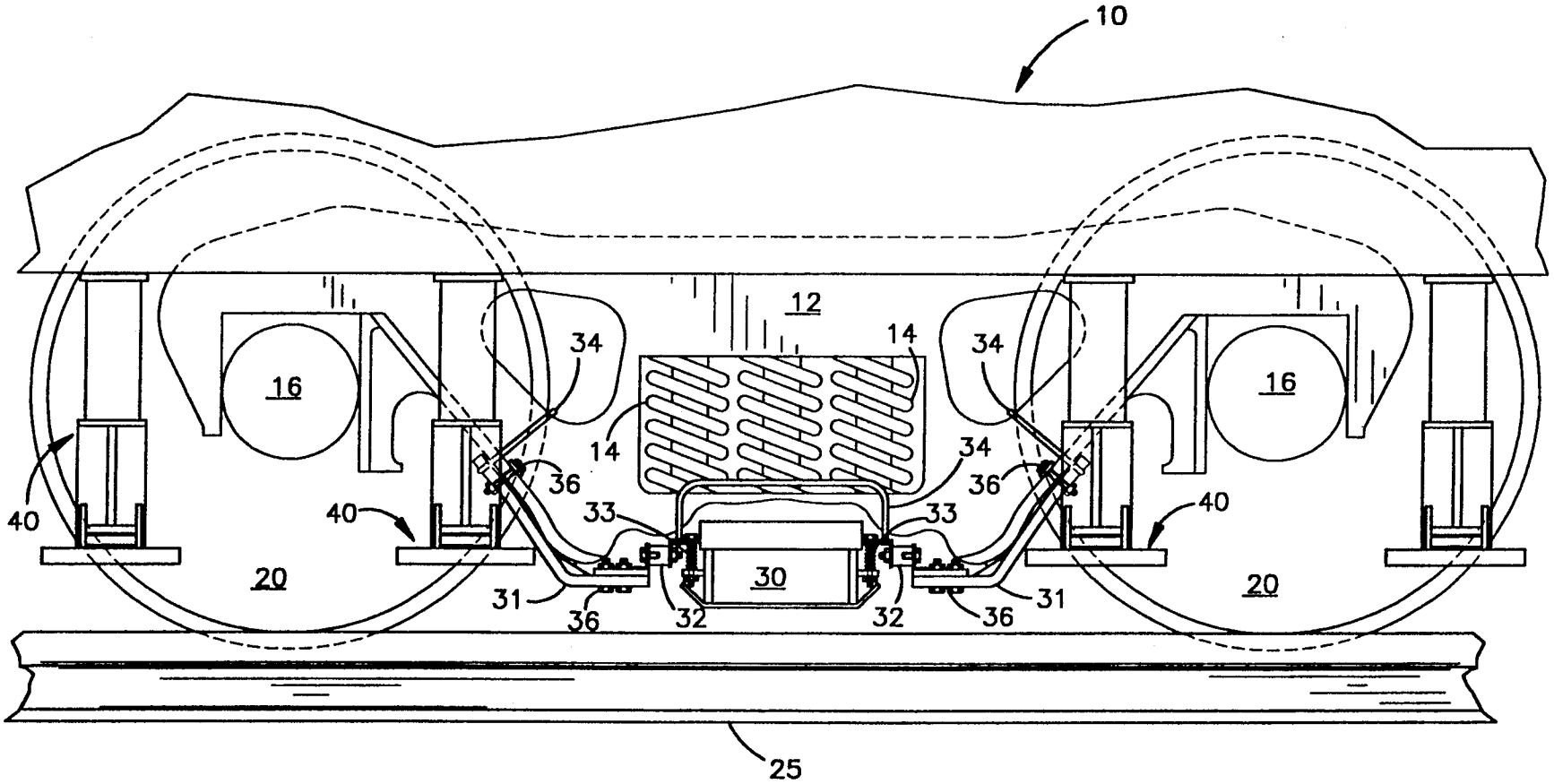
FIG. 1 is a elevational side view of the present invention installed on a truck of a railroad car.
Figure 2:
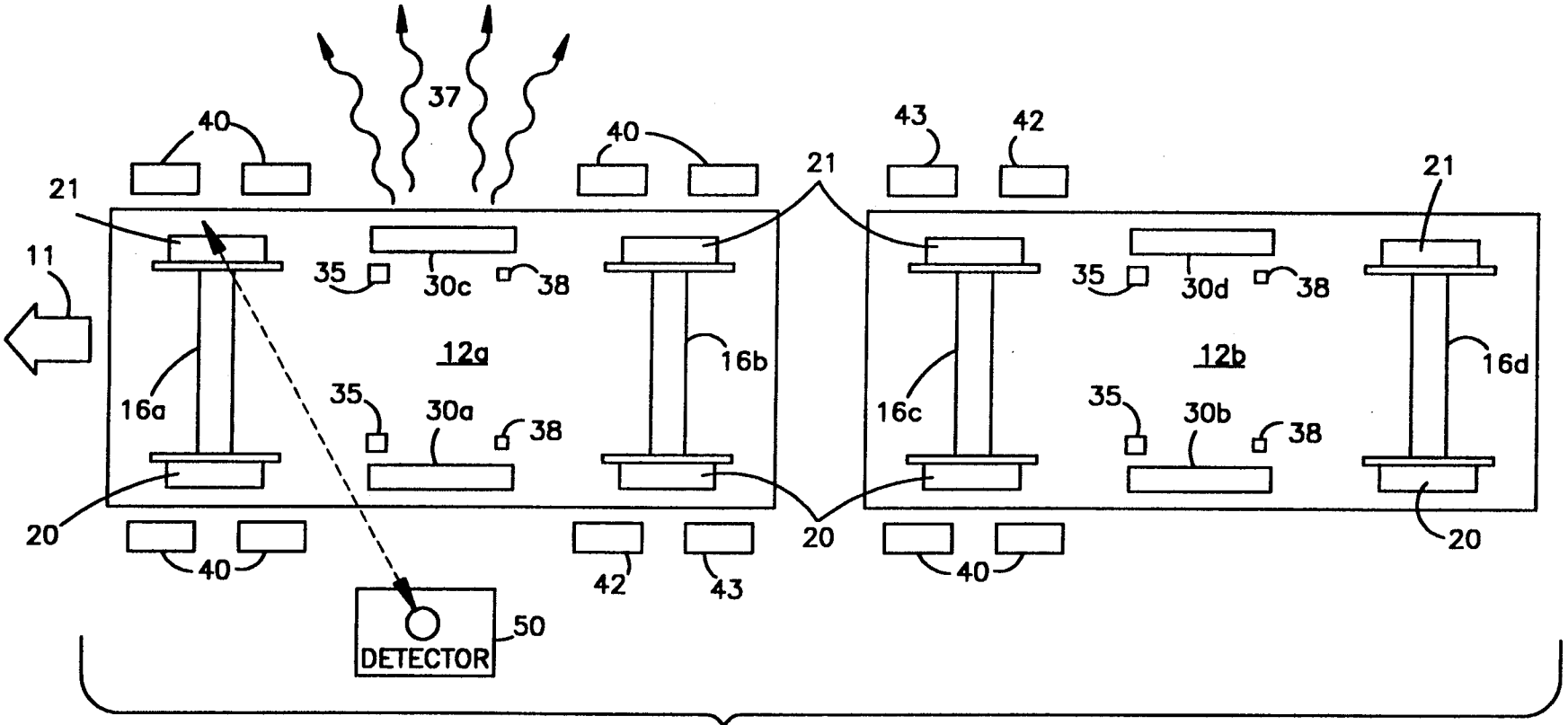
FIG. 2 is a schematic plan view of two trucks of a railroad car.

As shown in FIG. 1, a movable carriage, preferably railroad rolling stock such as a test car 10 has a truck 12 journalled thereon. The car usually has a second truck 12*b* which is substantially identical to the first truck 12*a*, as shown in FIG. 2. The car 10 rides on truck springs 14 disposed between the car 10 and the truck 12.

Figure 3:
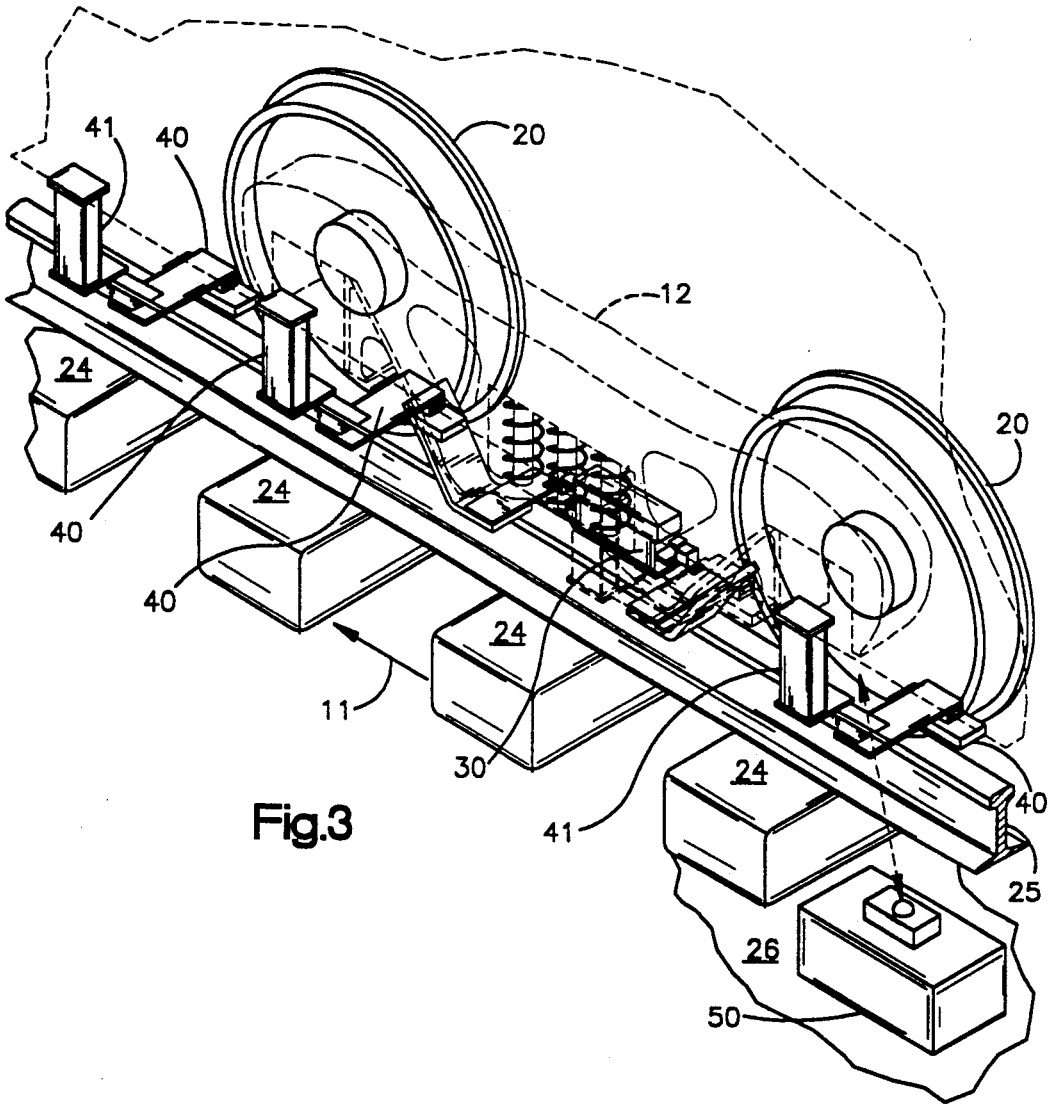
FIG. 3 is an isometric view of the present invention near a hot wheel detector.

Each truck has two parallel axles 16. The first truck 12*a* has axles 16*a* and 16*b* and the second truck 12*b* has axles 16*c* and 16*d*. Each axle has a left end with a left wheel 20 journalled thereon. Each axle also has a right end with a right wheel 21 journalled thereon. During travel, the wheels 20 and 21 roll on rails 25 mounted to ties 24 resting on a roadbed 26, as shown in FIG. 3. The car 10 has a predominant direction of travel 11 which defines a leading end.

Figure 4:
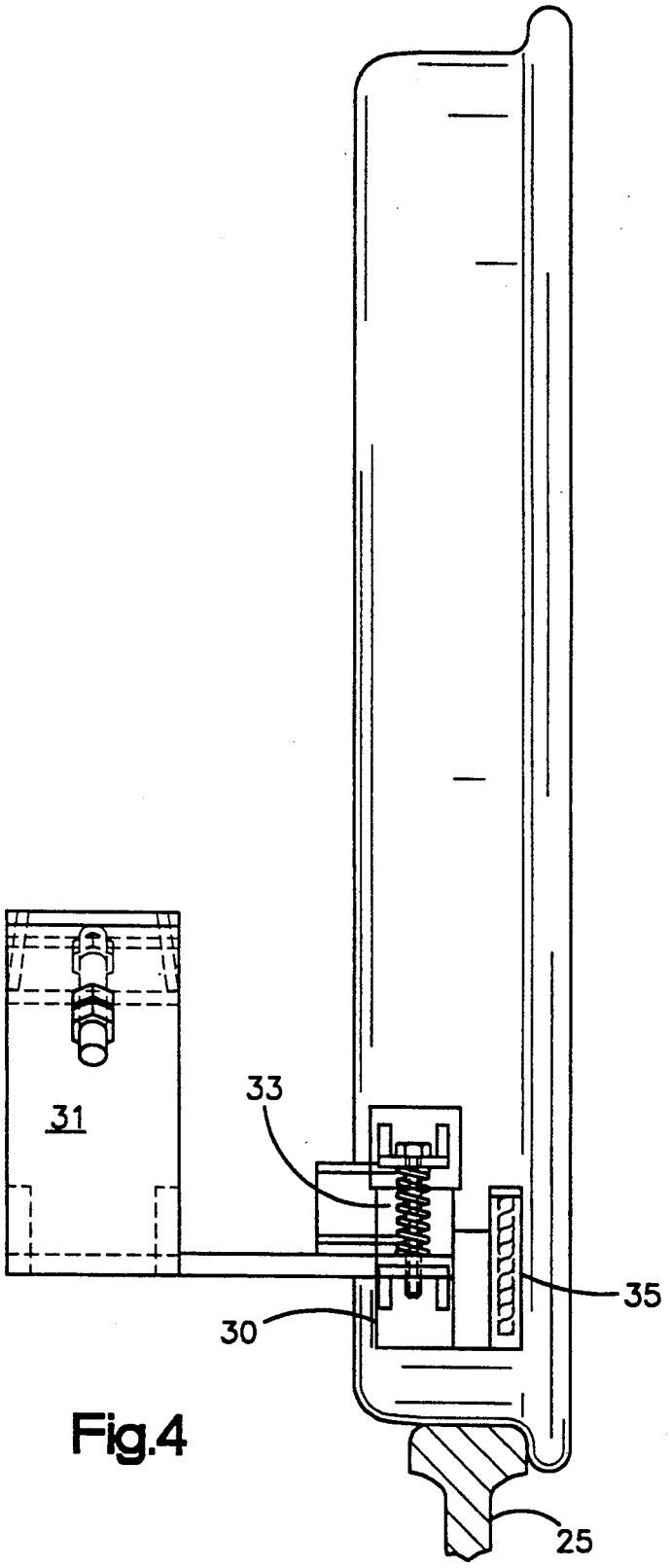
FIG. 4 is an end view detail of a wheel, heater and heater mount.

A heater 30 is disposed between the left wheels 20 on the truck 12, being spaced from each wheel in the order of a wheel radius. The heater 30 is disposed substantially within the profile formed by the thickness of the wheels, as shown in FIG. 4. That is each of the wheels has substantially coplanar inner and outer faces which are parallel and define a space therebetween. The heater 30 is located substantially between the planes of the faces of the wheels. The heater 30 is of a type which can direct heat in a selected direction and is positioned so that it directs heat 37 horizontally outwardly from the car 10, as shown in FIG. 2.

Although the preferred embodiment shows a car 10 having wheels 20 and 21 mounted on axles 16 attached to trucks 12, the carriage could include only one wheel rotatably mounted on the carriage by some other means. The heater 30 would be mounted on the carriage within the profile of the wheel 20.

A bracket 31 is attached to the underside of the truck 12 to support the heater 30 with standard hardware 36. Preferably shock mounts 32 are attached between the heater 30 and bracket 31. The shock mounts 32 damp vibrations from the wheels, axles and truck. In addition, spring mounts 33 should be attached between the bracket 31 and heater 30. The spring mounts 33 permit vertical deflection of the heater should it encounter an obstacle.

Safety cables 34 should be attached to the heater 30 and bracket 34 so that, if some part of the mounting hardware 36 should fail, the heater and bracket would be prevented from dragging below the truck.

A magnet 35, preferably an electromagnet, is attached to the heater 30. The magnet 35 should be located on the inner side of the heater and toward the leading end of the truck 12.

Hot bearing simulators 40, such as those described in U.S. Pat. Nos. 4,878,437 and 4,974,797, can be mounted on the car 10 near the ends of the axles 16 by means of a hot bearing simulator mount 41. Because of the location of the hot bearing simulators 40, they block the ability of hot bearing detectors to scan a bearing adjacent a simulator. Thus, onboard sensors are used as described in U.S. Pat. Nos. 4,878,437 and 4,974,797. One of the conditions sensed by the hot bearing detectors is a substantial differential in temperature between opposing bearings on the same axle. If a bearing on one side of a truck is blocked by hot bearing simulators and the opposing bearing is not blocked, a detector may incorrectly detect such a substantial temperature differential. Thus, a passive mask assembly 42 is mounted in a position similar to that of a hot bearing simulator as shown in FIG. 2.

An ambient temperature sensor 43 is preferably mounted on the truck adjacent a wheel which is not adjacent a hot bearing simulator 40. The ambient sensor 43 is located similarly to where the hot bearing simulators 40 are located near other wheels. The ambient sensor 43 also acts as a mask to block scanning of its adjacent bearing as discussed above for mask assemblies 42.

In the system shown in FIG. 2, the first truck 12*a* has, on its left side, two hot bearing simulators 40 located near the leading axle 16*a*, one masking assembly 42 and one ambient temperature sensor 43 located near the trailing axle 16*b* and one heater 30*a* located between the axles 16*a* and 16*b*. Each of these is electrically connected to wheel truck junction box 61*a*, FIG. 5.

On the right side of the first truck 12*a* are located two hot bearing simulators 40 near the leading axle 16*a*, two hot bearing simulators 40 near the trailing axle 16*b* and one heater 30*c* between the axles 16*a* and 16*b*. These are electrically connected to wheel truck junction box 61*b*.

On the second truck 12*b*, two hot bearing simulators 40 are located on the left side near the leading axle 16*c*, one ambient temperature sensor 43 and one mask assembly 42 are located on the right side and heaters 30*b* and 30*d* are located on opposite sides between the axles 16*c* and 16*d*. These are electrically connected to wheel truck junction box 61*c*.

A hot wheel detector 50, of a type known in the art, is located on the roadbed 26 near the rail 25. The detector 50 is positioned to scan substantially horizontally at the top of or slightly above the rail 25, as shown in FIGS. 2 and 3.

In operation, the heaters 30*a*-30*d* are controlled by known means to generate thermal radiation directed horizontally outwardly from the car 10. The horizontally outward direction of the radiated heat helps prevent interference with the operation of the hot bearing simulator 40. The thermal radiation is controlled to simulate a wheel at a specified temperature above ambient so that, when the heater is within the field being scanned by the detector 50, the detector will sense a wheel having the specified temperature.

In some installations, the hot wheel detectors 50 are turned on and off by magnetic sensing transducers which are presently used on railways. The transducer may be located adjacent the detector to turn the detector on and off for each wheel or axle. Alternatively, the transducer may be located some distance from the detector to turn the detector on for the duration of passing of an entire train. The magnet 35 activates any type of magnetically activated detector 50.

Figure 5:
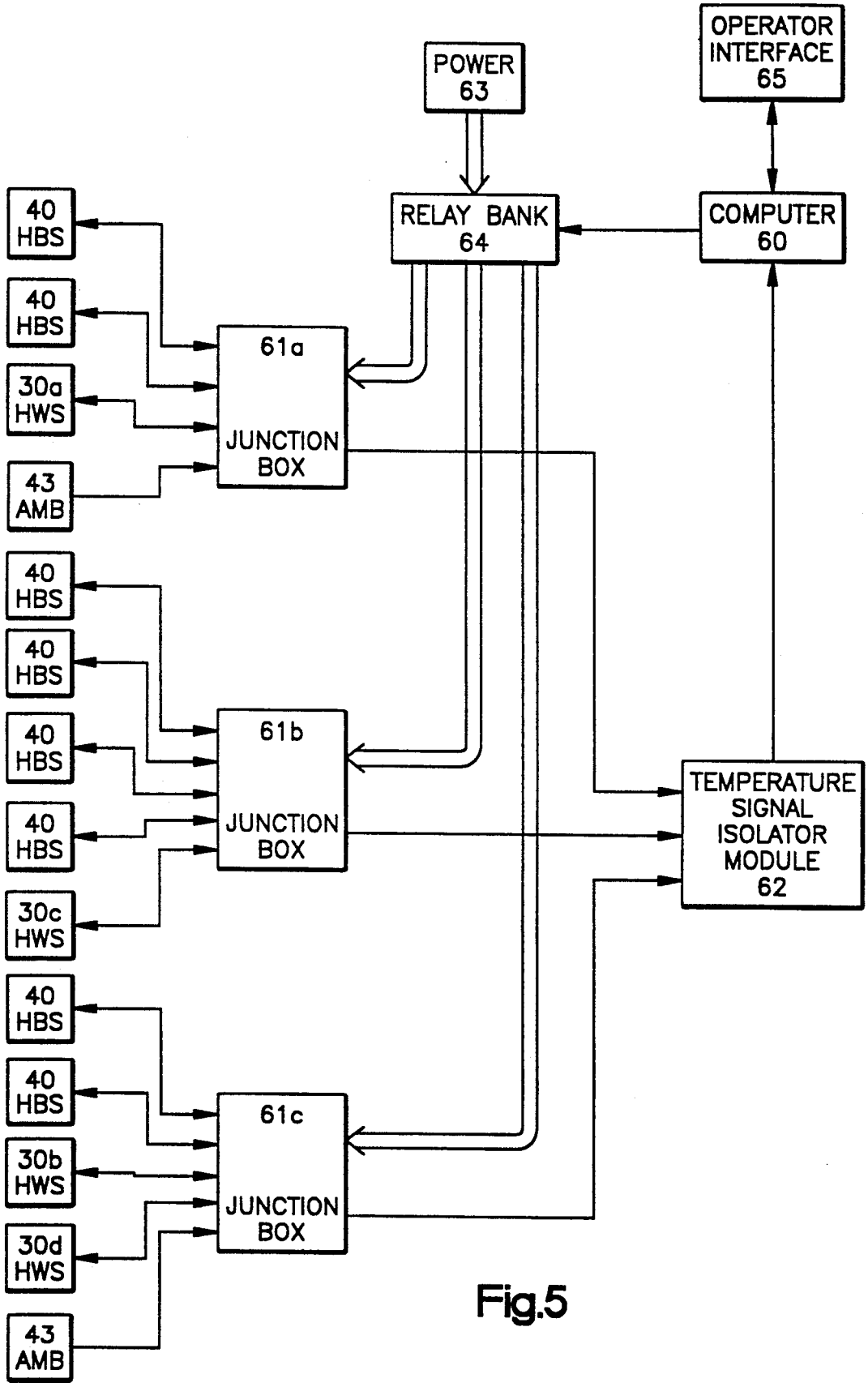
FIG. 5 is a block diagram of an integrated hot wheel and hot bearing simulator control system.

Referring to FIG. 5, the ambient sensor 43 provides ambient temperature information to a computer 60 by connections through a wheel truck junction box 61 and a temperature signal isolation module 62. The computer includes an operator interface 65 such as a display, keyboard and printer so that an operator can input information such as operating parameters and can receive system information.

Each heater 30 includes a temperature sensor such as a thermocouple 38 which provides feedback information on the temperature of the heater to the computer 60 by connections through a wheel truck junction box 61 and the temperature signal isolation module 62.

Electrical power 63 is supplied to the heaters through a relay bank 64 and a junction box 61. The computer controls the temperature of the heaters 30 in response to the temperature information from the ambient sensors 43 and the thermocouples 38 to maintain a specified temperature above ambient as discussed below. The temperature of the heaters 30 is controlled by varying the duty cycle of the power supplied to the heater by switching a relay in the relay bank 64. Alternatively, the magnitude of the voltage supplied to the heater 30 can be varied to control the heater temperature.

The temperature of the hot bearing simulators 40 is controlled by the computer 60 in a similar manner to the control of the hot wheel simulator heaters 30 by using temperature information from the same ambient temperature sensors 43.

The preferred configuration of the hot wheel simulator includes four heaters 30, as shown in FIG. 2. A low temperature heater **30*a* is located on the left side of the leading truck 12*a*. This heater 30*a* simulates a wheel temperature above ambient which is slightly lower than the temperature of a hot wheel. For example, the heater simulates a wheel at 495° F. above ambient which should not trigger a detector 50 set to detect a wheel at 500° F. above ambient. A high temperature heater 30*b* is located on the left side of the trailing truck 12*b*. This heater 30*b* simulates a wheel temperature above ambient which is at least as high as the temperature of a hot wheel. For example, the heater simulates a wheel at 545° F. above ambient which should be detected by a detector 50 set at 500° F. above ambient. An actual hot wheel creates heat where the wheel contacts the rail, whereas a heater 30 simulating a hot wheel is mounted above the rail. Thus, the heater 30 must create thermal radiation somewhat greater than that of a hot wheel to simulate a hot wheel near the rail where a hot wheel detector 50** scans.

A second high temperature heater **30*c* and a second low temperature heater 30*d* should be located on the right side of the corresponding trucks 12*a* and 12*b* for verifying the operation of detectors located on the right side of the car or for use when the direction of travel is reversed. The operation of these second heaters is identical to that of the first heaters 30*a* and 30*b***.

When the test car 10 having the hot wheel simulator installed passes a hot wheel detector 50, the magnet 35 activates the detector. As the low temperature heater **30*a* passes through the field being scanned by the detector 50, the detector should measure the thermal radiation of the heater, but the detector should not detect a hot wheel. Then, the high temperature heater 30*b* passes through the field being scanned by the detector 50** and the detector should detect thermal radiation equivalent to a hot wheel. The detector should then actuate an alarm indicating that it has detected a hot wheel.

The detector is aimed at an angle so that it can detect a hot wheel on the near end of an axle and then, as the train passes, on the far end of the same axle, as shown in FIG. 2. Although it is possible for the detector 50 to measure a heater on the opposite side, the heaters 30 of the hot wheel simulator shown are designed to direct heat only outwardly so that only simulators on the side nearest the detector 50 will be used.

If a hot wheel is detected when the low temperature heater **30*a* passes the detector, the detector is probably miscalibrated or defective. If a hot wheel is not detected when the high temperature heater 30*b*** passes the detector, it might mean that the detector was not activated, is inoperative, misaligned, miscalibrated or otherwise defective and needs attention. In this manner, the hot wheel simulator can verify the proper operation of a hot wheel detector.

Since a test car is likely to have both a hot bearing simulator and a hot wheel simulator installed, the controls should be integrated so that they can cooperate by using the same ambient sensors and computer as described above. Also, the hot wheel detector and the hot bearing detector may be in close proximity, thus, the heaters should not interfere with each other.

The present disclosure describes several embodiments of the invention, however, the invention is not limited to these embodiments. Other variations are contemplated to be within the spirit and scope of the invention and appended claims.

What we claim is:

1. An apparatus for simulating a hot wheel on railroad rolling stock to verify the operation of a hot wheel detector, comprising:

a movable carriage having left and right sides;

at least one left wheel rotatably mounted on the left side of the carriage having substantially parallel inner and outer faces defining substantially parallel planes; and at least one heater attached to the carriage and disposed substantially between the planes of the faces of the left wheel to simulate a hot wheel.

2. A hot wheel simulator according to claim 1, further comprising a second wheel rotatably mounted on the carriage, the second wheel having substantially parallel inner and outer faces defining planes substantially coplanar with the planes of the faces of the first wheel.

3. A hot wheel simulator according to claim 2, wherein the heater is disposed between the wheels.

4. A hot wheel simulator according to claim 1, further comprising means to control the temperature of the heater by varying power supplied to the heater.

5. A hot wheel simulator according to claim 4, wherein the temperature control means includes a means to sense the temperature of the heater.

6. A hot wheel simulator according to claim 1, wherein the heater has a substantially constant temperature above ambient.

7. A hot wheel simulator according to claim 6, further comprising an ambient temperature sensor operatively connected to the heater and a means to control the temperature of the heater relative to the ambient temperature.

8. A hot wheel simulator according to claim 7, wherein the ambient temperature sensor is also connected to a hot bearing simulator system.

9. A hot wheel simulator according to claim 1, wherein the heater directs heat horizontally outwardly relative to the carriage.

10. A hot wheel simulator according to claim 1, wherein the carriage includes a car riding on a truck.

11. A hot wheel simulator according to claim 10, further comprising an axle attached to the truck and having the wheel attached thereto.

12. A hot wheel simulator according to claim 10, further comprising truck springs disposed between the car and truck so that the truck is an unsprung weight relative to the wheel, the heater being disposed on the truck so that it does not move vertically with the car relative to the truck.

13. A hot wheel simulator according to claim 1, wherein the heater is mounted at a distance from the wheel in the order of a wheel radius so as to prevent heat from the wheel from interfering with verification of detector operation.

14. A hot wheel simulator according to claim 1, wherein the heater is mounted in proximity to a rail on which the left wheel rides.

15. A hot wheel simulator according to claim 14, further comprising a hot wheel detector located near the rail to measure thermal radiation near the rail.

16. A hot wheel simulator according to claim 1, further comprising shock mounts attached between the heater and the carriage.

17. A hot wheel simulator according to claim 1, further comprising spring mounts attached between the heater and the carriage to permit upward movement of the heater if it encounters an obstacle.

18. A hot wheel simulator according to claim 1, further comprising at least one safety cable attached to the carriage and the heater to prevent the heater from falling from the carriage.

19. A hot wheel simulator according to claim 1, further comprising a magnet disposed on the carriage to trigger a magnetic sensor in the hot wheel detector.

20. A hot wheel simulator according to claim 19, wherein the magnet is an electromagnet.

21. A hot wheel simulator according to claim 19, wherein the magnet is mounted on the heater.

22. A hot wheel simulator according to claim 21, wherein the carriage has a predominant direction of travel defining a leading end of the heater, the magnet being positioned closer to the leading end.

23. A hot wheel simulator according to claim 1, wherein the heater is a high temperature heater and further comprising a low temperature heater having a temperature lower than the high temperature heater and being disposed substantially between the plains of the faces of the left wheel to simulate a wheel below the temperature of a hot wheel on the left side of the carriage.

24. An apparatus for simulating a hot wheel on railroad rolling stock to verify the operation of a hot wheel detector, comprising:

a movable carriage having at least two axles, the axles being generally parallel to each other and each axle having corresponding left and right ends;

a wheel at each end of each axle, the left wheels each having inner and outer faces such that the respective faces of the left wheels are substantially coplanar, the inner and outer planes of the faces being parallel and defining a space therebetween; and at least one heater disposed substantially between the planes of the inner and outer faces of the left wheels to simulate a hot wheel.

25. An apparatus for simulating a hot wheel on railroad rolling stock to verify the operation of a hot wheel detector, comprising:

a movable carriage having at least four horizontal axles (A, B, C and D), the axles being generally parallel to each other and each axle having corresponding left and right ends, the carriage including a car riding on first and second trucks, the first truck having axles A and B and the second truck having axles C and D;

a wheel at each end of each axle, the wheels each having inner and outer faces such that the respective faces of the wheels on the left end of the axles are substantially coplanar, the inner and outer planes of the faces being parallel and defining a space therebetween;

a left, high temperature heater disposed between the wheels at the left end of the axles of the first truck, substantially between the planes of the faces of the wheels on the left end of the axles for directing heat generally horizontally outwardly from the carriage at a substantially constant temperature above ambient to simulate a hot wheel on the left side of the carriage, the heater being mounted at a distance from the wheels in the order of a wheel radius so as to prevent heat from the wheels from interfering with verification of detector operation; and a left, low temperature heater having a temperature lower than the left, high temperature heater and being disposed between the wheels at the left end of the axles of the second truck, substantially between the planes of the faces of the wheels on the left end of the axles to simulate a wheel below the temperature of a hot wheel below the temperature of a hot wheel on the left side of the carriage, the heater being mounted at a distance from the wheels in the order of a wheel radius so as to prevent heat from the wheels from interfering with verification of detector operation.

* * * * *

UNITED STATES PATENT AND TRADEMARK OFFICE

CERTIFICATE OF CORRECTION

PATENT NO. : 5,292,090
DATED : March 8, 1994
INVENTOR(S) : Donald C. Wetzel, et. al.

It is certified that error appears in the above-indentified patent and that said Letters Patent is hereby corrected as shown below:

Column 3, line 53, after "is" insert --,--

Claim 25:
Line 56, after "wheel" delete --below the temperature--
Line 57, delete --of a hot wheel--

Signed and Sealed this

Twentieth Day of September, 1994

Bruce Lehman

*Attest:*

BRUCE LEHMAN

*Attesting Officer*

*Commissioner of Patents and Trademarks*